US005738354A

United States Patent [19]

Easley

[11] Patent Number: 5,738,354

[45] Date of Patent: Apr. 14, 1998

[54] EDUCATIONAL BOARD GAME

[76] Inventor: Aaron G. Easley, 505 Bredin Ave., Butler, Pa. 16001

[21] Appl. No.: 709,309

[22] Filed: Sep. 9, 1996

[51] Int. Cl.[6] ..... A63F 3/00; A63F 9/18

[52] U.S. Cl. ..... 273/249; 273/148 A; 273/309; 273/431; 273/280

[58] Field of Search ..... 273/249, 248, 273/243, 250–254, 148 A, 280, 429–432

[56] References Cited

U.S. PATENT DOCUMENTS

| | | | |
|---|---|---|---|
| 1,635,734 | 7/1927 | Ziegler | 273/249 |
| 4,090,717 | 5/1978 | Rossetti | 273/249 |
| 4,487,418 | 12/1984 | Allen, Sr. | 273/248 |
| 4,557,485 | 12/1985 | Lardon | 273/249 |
| 4,572,513 | 2/1986 | Evans | 273/249 |
| 4,682,777 | 7/1987 | Wood | 273/243 |
| 4,714,255 | 12/1987 | Henry et al. | 273/249 |
| 4,854,594 | 8/1989 | Eaton | 273/249 |
| 4,907,808 | 3/1990 | Turner et al. | 273/240 |
| 4,932,667 | 6/1990 | Gorski et al. | 273/249 |
| 5,094,465 | 3/1992 | Dawson | 273/429 |
| 5,472,207 | 12/1995 | Sullivan, Jr. et al. | 273/249 |

OTHER PUBLICATIONS

"Nameburst", Games Magazine, Apr. 1993 p. 48.

*Primary Examiner*—Benjamin H. Layno
*Attorney, Agent, or Firm*—George C. Atwell

[57] ABSTRACT

An entertainment and educational board game is disclosed which requires players to answer questions arranged in a hierarchy ranging from most difficult questions to questions of intermediate difficulty, and then to questions of least difficulty, and includes a playing board, a star-shaped playing course on the playing board and formed from a plurality of joined playing spaces, a plurality of sets of question cards with each set representing a particular question category, a plurality of question card boxes for the sets of question cards, and a rotatable question card box holder having compartments for holding the question card boxes and question cards. The players take turns in their attempts to correctly answer the questions printed on the question cards starting with the most difficult question level. The particular question card selected by each player as a result of his or her playing piece landing on a respective playing space corresponding to the question category for that question card set is inserted into and concealed within a scrolling pad. The questions on the back of the question card are read by another player holding the scrolling pad starting from the most difficult questions and proceeding to the least difficult questions. It is the intent of each of the participants in the game to be the first player to reach a specific end space located within the playing course and to correctly answer the question or questions on a question card selected from a predetermined question category.

7 Claims, 7 Drawing Sheets

EDUCATIONAL BOARD GAME

BACKGROUND OF THE INVENTION

The present invention relates to board games, and, more particularly, pertains to an entertainment and educational board game which requires players to answer questions arranged in a hierarchy extending from most difficult questions to least difficult questions, the questions representative of various realms of human culture and society.

Despite the advent of the home computer and the popularity of electronic games, of which Nintendo and Sega are the current favorites, board games retain their appeal and show no signs of falling into obsolescence as have other once popular forms of entertainment, such as the drive-in movie theater. Board games pleasurably combine qualities of life in general—calculated risk taking, weighing and evaluating the odds that an outcome will or will not occur, formulating strategies to meet a variety of future occurrences, and the indeterminancy involved with a lucky roll of the dice—in the miniaturized setting of the board game. Depending on the board game chosen, the players can target and sink an opponent's battleship; amass and manipulate real estate holdings, as in the classic Monopoly board game (U.S. Pat. No. 2,026,082); traverse medieval landscapes evading the dangers and mysteries lurking therein; or answer questions, both trivial and profound, drawn from every aspect of human experience and knowledge, as in the game of Trivial Pursuit. Indeed, the number and types of board games are limited only by the scope of human ingenuity.

The prior art reveals a number of board games having varying objectives, modes of play, and goals. For example, U.S. Pat. No. 1,635,734 (Ziegler) discloses a board game which requires players to correctly answer a question drawn from various categories, and, if the question is answered correctly, the player advances on the game board squares the number indicated on the question card. The first player to reach the goal, which is a schoolhouse on the game board, is declared the winner.

U.S. Pat. No. 4,090,717 (Rosetti) features a game board and a plurality of question cards, and requires the use of an encyclopedia for assisting each player in correctly answering the question cards.

U.S. Pat. No. 4,487,418 (Allen Sr.) discloses a game apparatus which includes a set of circular disks rotatably mounted on a post screw. The disks comprise a base, a question disk, an answer disk, a cover disk, and also a pointer. By spinning the pointer and rotating the various disks, questions and answers are uncovered.

U.S. Pat. No. 4,572,513 (Evans) discloses an educational board game wherein an audio recording contains the questions and answers.

U.S. Pat. No. 5,094,465 (Dawson) discloses a shape recognition game which includes a number of clue cards arranged in a hierarchy where the simplest set of clue cards has a portion of a common object drawn thereon. The cards are graduated so that the last set of cards includes the complete object illustrated thereon.

Despite the ingenuity and the pleasurable effects derived from playing the above-mentioned board games, there remains a need for a board game which is comparatively more challenging intellectually and which increases one's knowledge of the world.

SUMMARY OF THE INVENTION

The present invention comprehends an entertainment and educational board game in which a plurality of players attempt to correctly answer questions arranged in a hierarchy extending from a most difficult question level, to a question level of intermediate difficulty, and then to a question level of least difficulty, and in which the answers of one level build upon and relate to the answers of the next level.

The entertainment and educational board game includes a playing board having a playing surface on which is illustrated a playing course in the shape of a five-pointed star. The playing course defines the path of travel for the players, and is further composed of a plurality of joined playing spaces. The majority of playing spaces contain indicia which denote one category drawn from a plurality of question categories, and the remaining playing spaces contain indicia which direct that any player landing thereon must then move in a certain prescribed manner. In addition, one playing space contains indicia which designates that playing space as the playing space upon which play of the board game is to commence. Also, an end space is located within the playing course, and the end space is in the form of a five-pointed star. The first player to traverse the playing course enters the end space, and the first player that correctly answers a question drawn from a predetermined category is the winner of the game.

The entertainment and educational board game includes a plurality of sets of question cards, and each card from each set contains a plurality of questions from each of the three levels. The questions from each level are representative of the question category for that particular set. The question categories are drawn from both the human and natural world and include, but are not limited to, the following topics: geography, showtime (entertainment), music history, sports, chance (a catch-all category), wildlife, government and law, transportation, foods, medicine, literature, architecture, art, biology, and religion. The sets of question cards are stored within question card boxes appropriately labeled so that each set of question cards corresponds to a respective question card box. Furthermore, a Lazy Susan-type device in the form of a cylindrical question card box holder having a rotatable upper member and a lower bearing support member is used to hold the sets of question card boxes. The upper member is divided into a plurality of compartments and each question card box can be set within a respective compartment. A plurality of playing pieces or icons are used to represent each player or team of players, and the playing pieces can be in the form of chess pawns.

It is an entertainment and objective of the present invention to provide an educational board game which increases the general knowledge of the players.

Another objective of the present invention is to provide a board game which is entertaining and educational for the players in a friendly and competitive setting.

These and other objects of the invention will become apparent from the following detailed description of the invention, from the attached drawings, and from the appended claims.

DETAILED DESCRIPTION OF THE PREFERRED EMBODIMENT

Figure 1:
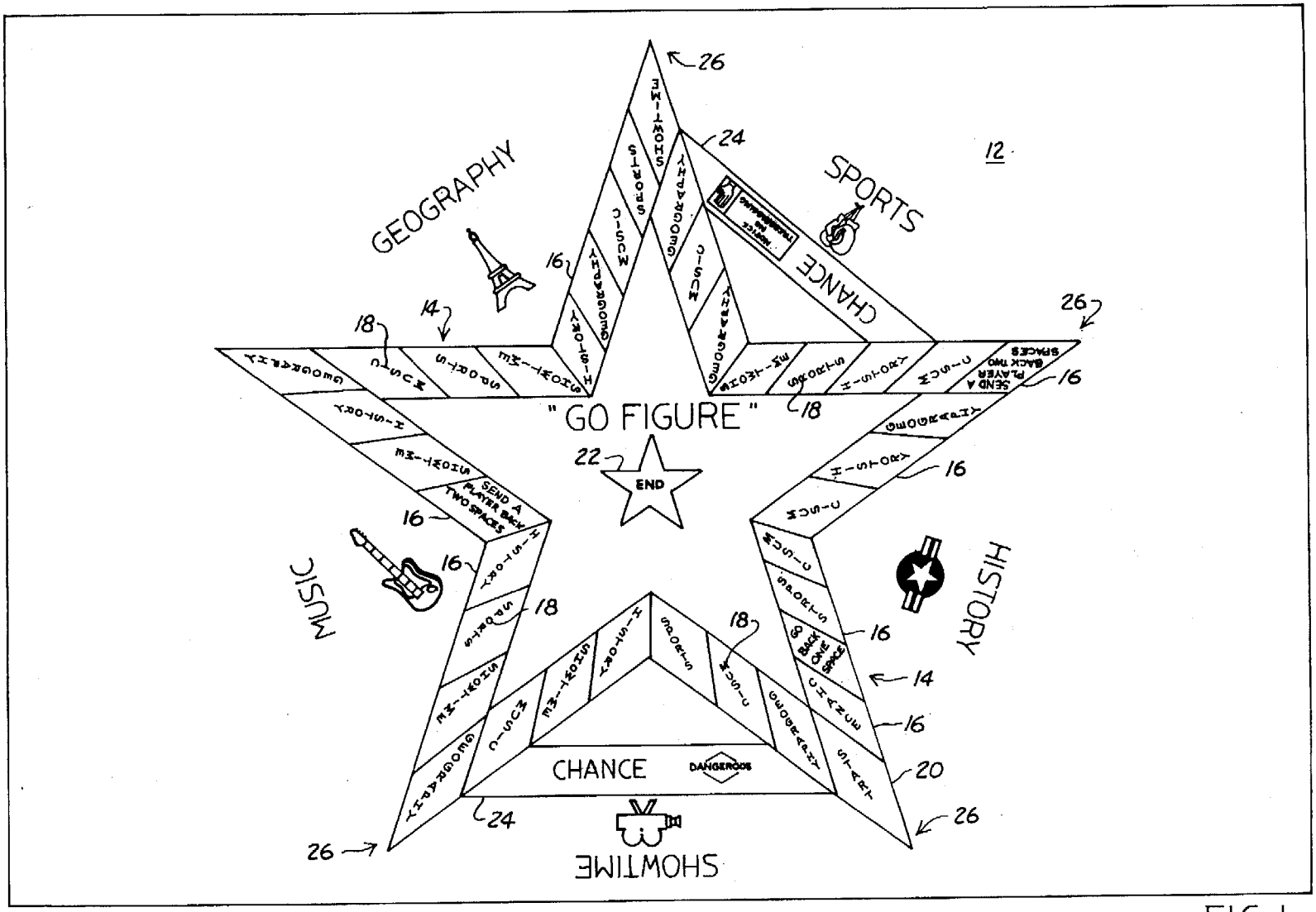
FIG. 1 is a top plan view of the board game of the present invention.

Illustrated in FIGS. 1–16 is a preferred embodiment of an entertainment and educational board game which can be played by a plurality of players or by a plurality of playing teams, and which is designed to both provide entertainment for the players and enhance their knowledge of the world. The board game includes a foldable playing board 10 manufactured from a durable and water-resistant cardboard or plastic material. The board 10 has an undersurface or backing and an opposite playing surface 12. Illustrated upon the surface 12 is a playing course 14 which is in the form of a five-pointed star. Located adjacent to the outer perimeter of the course 14 are artistic illustrations which represent certain features or aspects of the board game which will be hereinafter further described. The course 14 defines the path of travel which the players take during play of the game, and the course 14 is divided into a plurality of joined playing spaces 16 having the shape of a rhombus and each of which contains indicia 18 relating to the actual play of the game and the overall theme of the game. One playing space 20 has the word "START" contained within its borders and this START space 20 designates the playing space on which play of the board game is to commence. The termination of play of the game is designated by one playing space 22 which is located within the course 14, and is represented by a star-shaped symbol containing the word "END" therein. This END space 22 denotes the space on which the winner of the game is determined and play of the game is concluded. In addition to the course 14 containing a plurality of spaces 16 and the END space 22, the course 14 includes a plurality of CHANCE pathways 24 which extend from one space 16 adjacent the tip of one point 26 of the star-shaped course 14 to an opposite space 16 located within the tip of an adjacent point 26 of the star-shaped course 14. The purpose of the. CHANCE pathways 24 will be further described hereinafter.

Figure 4:
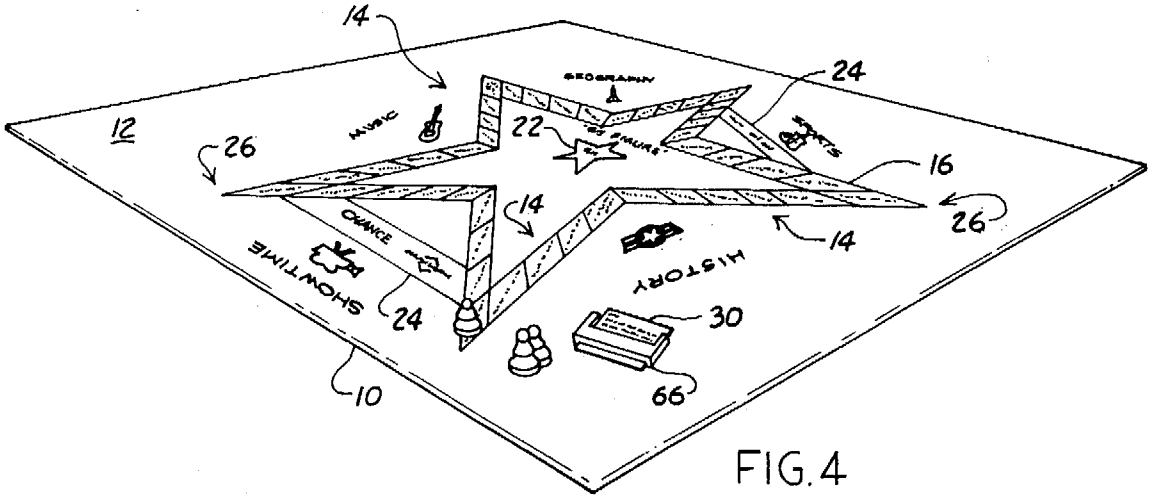
FIG. 4 is a perspective view of the board game first shown in FIG. 1.

As shown in FIGS. 1 and 4, a majority of the spaces 16 contain indicia 18 which denote or designate one particular question category representative of and corresponding to one question category drawn from a set or plurality of question categories which comprise one of the main features of the board game. The question categories are representative of every sphere or realm of the human and natural world. The present board game derives questions and clues from the following categories but will not exclude other categories: music, history, sports, geography, showtime (entertainment), wildlife, government and law, transportation, food, medicine, literature, architecture, art, biology, religion, and a CHANCE category which includes an amalgam of questions drawn from all of the previous question categories. In the present design of the board game, only five question categories are used, and the question categories illustrated in FIGS. 1 and 4 are music, geography, sports, history, and showtime. The CHANCE category is a catch-all category and would, in actuality, be the sixth question category used in the present embodiment of the board game. However, the above-listed question categories can be combined in a variety of ways so that each board game includes a unique set of five question categories in order to vary the play of each board game. In addition, a number of other question categories, such as archeology, travel, communication, current events, popular music, and philosophy, could be added to the above list. The question categories have been selected with the intention that anyone playing the game should at least have some familiarity with one of the topics from one of the question categories. To enhance the appeal and attractiveness of the game, all spaces 16 containing indicia 18 which denote one representative question category will be color-coded with a distinctive color.

Figures 11, 12:
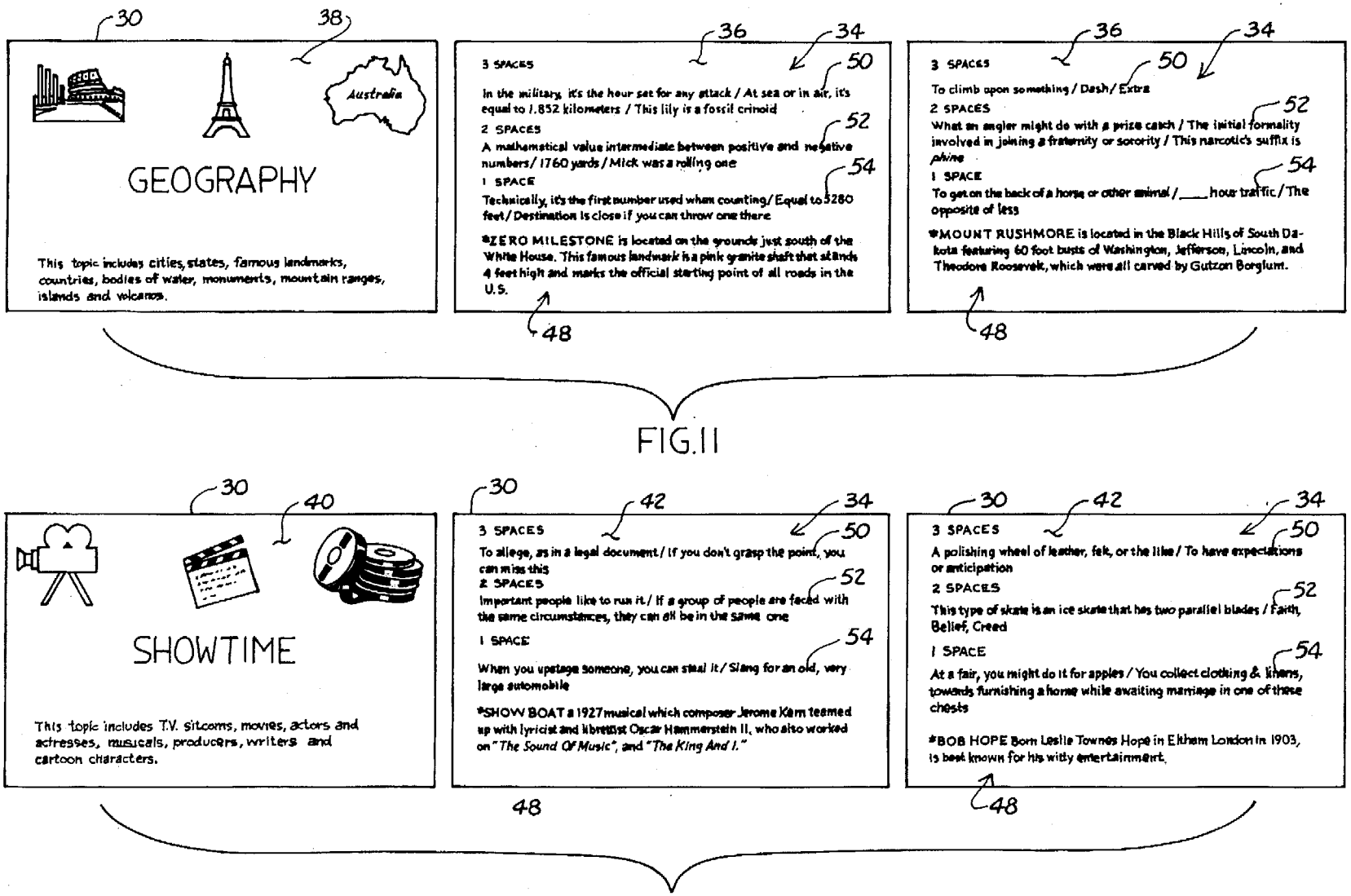
FIG. 11 is a top plan view of a plurality of question cards from the geography category.
FIG. 12 is a top plan view of a plurality of question cards from the showtime category.
Figure 13:
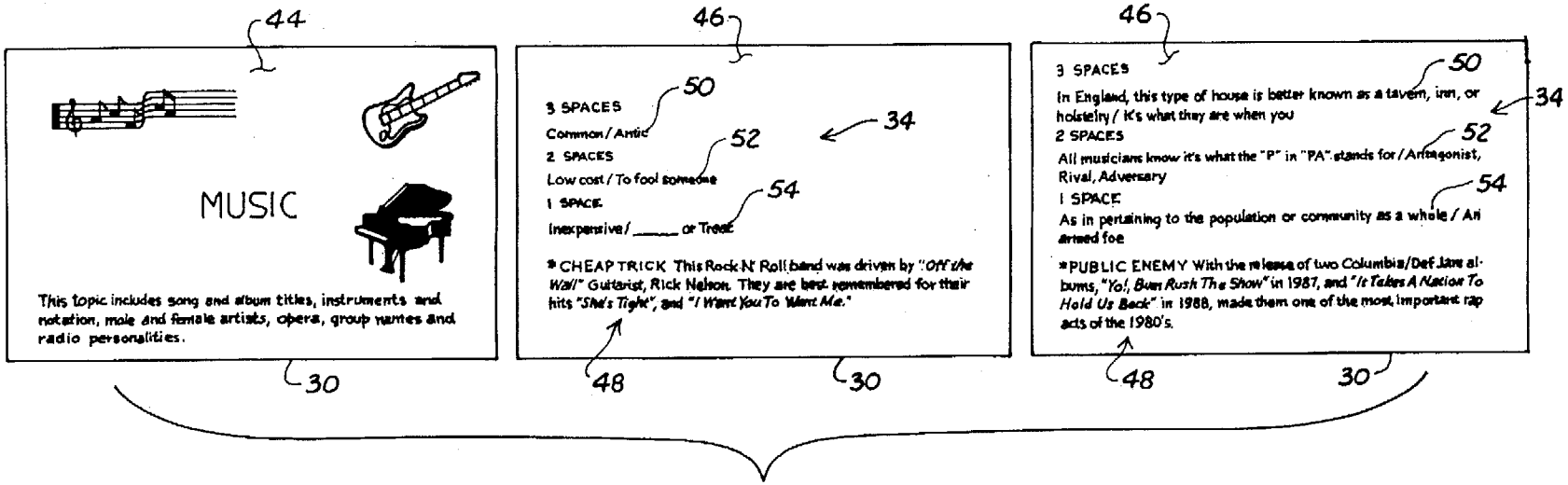
FIG. 13 is a top plan view of a plurality of question cards from the music category.
Figure 14:
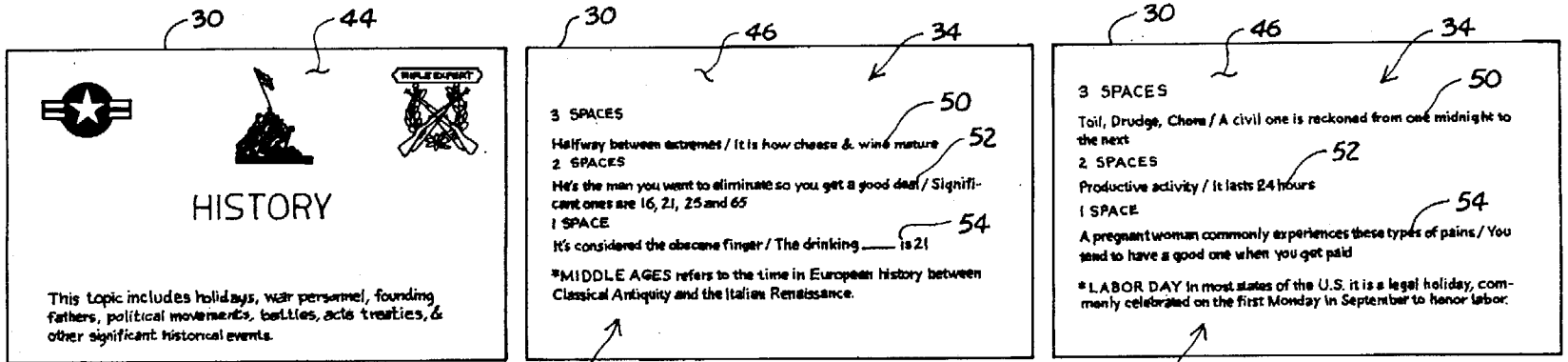
FIG. 14 is a top plan view of a plurality of question cards from the history category.
Figure 15:
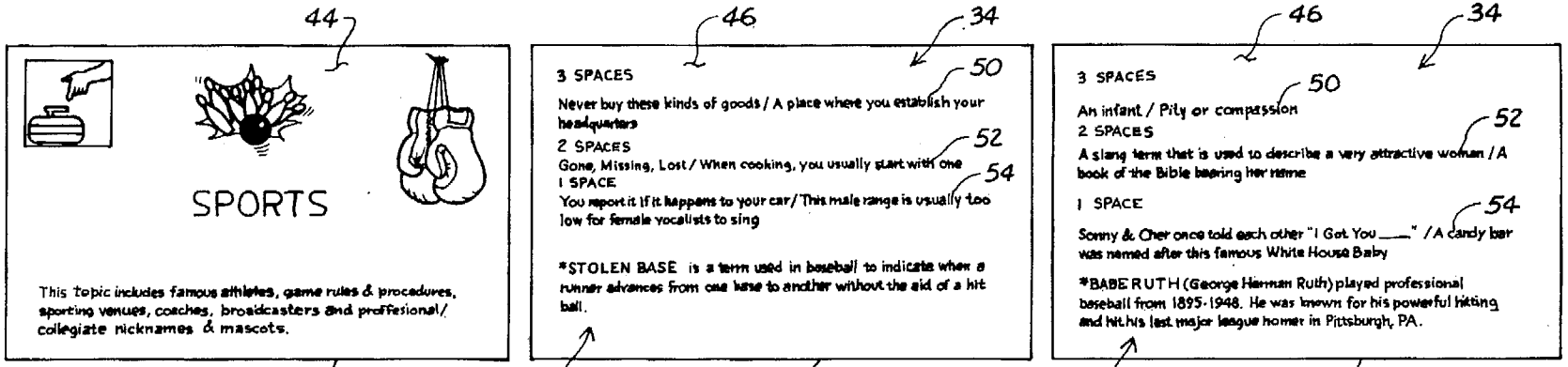
FIG. 15 is a top plan view of a plurality of question cards from the sports category.
Figure 16:
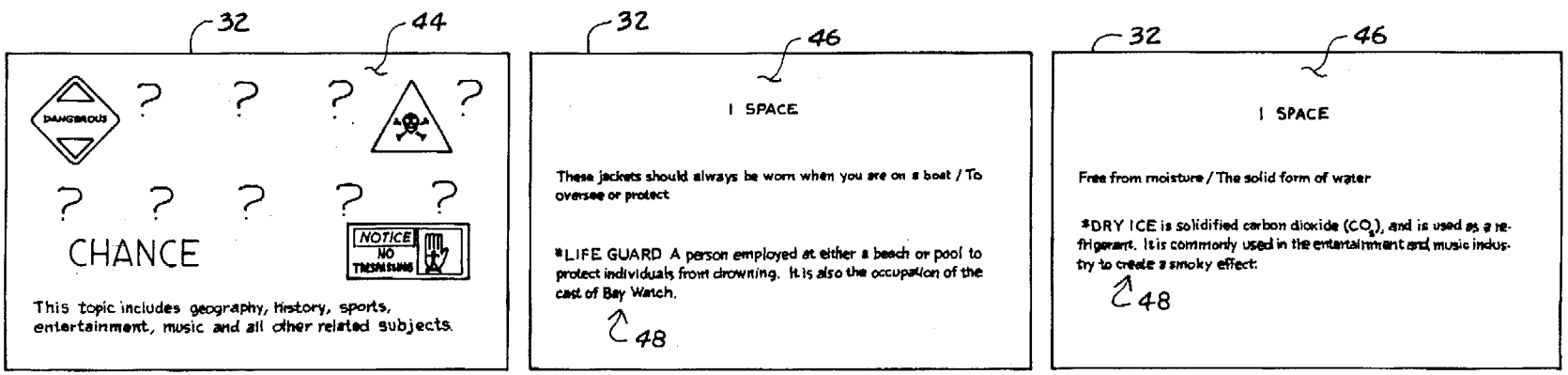
FIG. 16 is a top plan view of a plurality of question cards from the chance category.

In order to physically represent each question category, FIGS. 2–8 of the board game illustrate a plurality of question card sets 28. Each respective card set 28 corresponds to a designated question category located within at least one of the spaces 16 and to one question category indicated on the outer perimeter of the course 14. The present board game includes six card sets 28 pertaining to the following topics or categories: geography, sports, history, showtime, music, and the CHANCE category. FIGS. 11–15 illustrate representative examples of particular question cards 30 from each of the five question categories while FIG. 16 illustrates a representative CHANCE card 32. As shown in FIG. 11, statements or questions 34 are printed on the back 36 of each card 30. In essence, each statement or set of statements are set off by a slash ("/"), and poses a question. Thus, in this specification, the statements 34 are synonymous with the plurality of questions from each question level in the hierarchy. Moreover, a preceding level of questions 34 can be used as clues to deduce the answer to a subsequent level of questions 34. The questions 34 are arranged in a descending hierarchy and are all related to each other in content. The descending order Of the questions 34 are arranged in three levels from the most difficult questions to answer, then to questions of intermediate difficulty, and, finally, to questions which are the least difficult to answer.

FIG. 11 shows the front 38 of a representative card 30 from the geography category and two samples of the hierarchically-arranged questions 34 on the back side 36 of two geography cards 30. FIG. 12 illustrates a representative sample of the front 40 of a card 30 from the showtime question category and two samples of the questions 34 on the back side 42 of two showtime cards 30. FIGS. 13–16 illustrate the front 44 and back sides 46 of three representative cards 30 from the music, history, and sports question categories and also the front 44 and back 46 of one representative CHANCE card 32. Each card 30 contains on the back sides 36 and 42 three sets or levels of questions 34 pertaining to the topic or theme of the respective question category to which that card set 28 belongs. The questions 34 on each level are related in that answering all the questions 34 from a respective level yields an answer worth either three, two, or one spaces. The question level that is the most difficult to answer is worth three spaces if answered correctly, and if a player answers the questions correctly by using only the first or most difficult questions to deduce the answer, then that player can move three spaces on the course 14. If the player is unable to provide an answer using the first or most difficult question level, the player must descend to the second question level, which is worth two spaces if all the questions 34 from that level are answered correctly, and this is the question level of intermediate difficulty. If the player provided a correct answer by using the middle level questions of intermediate difficulty, then the player can move two spaces on the course 14. Correctly answered questions 34 from the previous level can be used as clues to answer the questions of intermediate difficulty. Finally, if the player is unable to answer the questions of both the most difficult and the intermediate difficulty levels, then the player still has the opportunity to provide a correct answer by using the questions of the least difficult level. This question level is the easiest to answer and is worth one space if answered correctly by the player. Again, correctly answered questions 34 from the most difficult and intermediate levels can be used as clues to provide an answer to the questions 34 of the least difficult level.

As shown in FIGS. 11–15, the three levels of questions 34 are related to each other; the questions of intermediate difficulty build upon the questions of the most difficult level, while the questions of the least difficult level build upon the questions given in the intermediate level and the most difficult level. Answers 48 are given at the bottom of cards 30 and 32. For example, with reference to FIG. 11, the answer 48 to this representative geography card 30 is "ZERO MILESTONE" which is a point located on the grounds south of the White House. This famous landmark is a pink granite shaft that stands four feet high and marks the official starting point of all roads in the United States. Looking at the most difficult question level 50, three separate questions 34 are given with each statement separated by a slash mark. The first question is "IN THE MILITARY, IT IS THE HOUR SET FOR ANY ATTACK." The second question is "AT SEA OR IN AIR, IT'S EQUAL TO 1.852 KILOMETERS." The last question in level 50 for this representative geography card 30 is "THIS LILY IS A FOSSIL CRINOID." Were a player to answer each question 34 correctly, in order, the answers would be "ZERO", "MILE", and "STONE". If the player is knowledgeable in geography, he or she would put the three answers together to come up with the answer "ZERO MILESTONE". The player could then advance three spaces on the course 14. However, if the player is only able to answer one or two of the questions 34 correctly from level 50, then the player would go to the second level 52, which are questions 34 of intermediate difficulty. For this representative geography card 30, the three questions 34 are: "A MATHEMATICAL VALUE INTERMEDIATE BETWEEN POSITIVE AND NEGATIVE NUMBERS", "1,760 YARDS", and "MICK WAS A ROLLING ONE". The player can combine the correct answers to the questions 34 given in level 50 with the correct answers for the questions 34 given in level 52 to give the correct answer for that level and advance two spaces on the course 14.

However, if the player is unable to provide the correct answer from the questions 34 provided in levels 50 and 52, then the player is given a final set of questions 34 worth one space. This set of questions 34 is the question level of least difficulty 54 and are, therefore, the easiest questions to answer. In the representative geography card 30 sample, the questions in level 54, worth one space, are "TECHNICALLY, IT'S THE FIRST NUMBER USED WHEN COUNTING", "EQUAL TO 5,280 FEET", and "DESTINATION IS CLOSE IF YOU CAN THROW ONE THERE". The answers for these questions 34 are, in order, "ZERO", "MILE", and "STONE"; and when combined they give the correct answer which is "ZERO MILESTONE". If the player correctly answers the related questions given in level 54, then the player can advance one space upon the course 14. The player can use as clues the correctly answered questions from levels 50 and 52 to provide the correct answer to question level 54.

The way in which questions 34 from levels 50 and 52 can be used as clues to deduce the answer to the lower level 54 is as follows with reference to the representative sample card 30 for the geography question category. Suppose the player were able to answer the first question 34 of level 50 but not the second or third questions 34. The answer to the first question 34 of level 50 is "ZERO". The player would then come down to level 52 and attempt to correctly answer the second and third questions so as to advance two spaces on the course 14. The player answers the question "MICK WAS A ROLLING ONE" correctly, and deduces that the answer to the question "A MATHEMATICAL VALUE INTERMEDIATE BETWEEN POSITIVE AND NEGATIVE NUMBERS" is "ZERO" from his correct answer to "IN THE MILITARY, IT'S THE HOUR SET FOR AN ATTACK" from level 50. However, the player is unable to give the correct answer to the question "AT SEA OR IN AIR, IT'S EQUAL TO 1.852 KILOMETERS" from level 50 and the question "1,760 YARDS" from level 52. Therefore, the player is given the questions 34 of level 54 which are worth one space. By analyzing the questions "AT SEA OR IN AIR, IT'S EQUAL TO 1.852 KILOMETERS" and "1,760 YARDS" from levels 50 and 52, the player is able to deduce from these questions and the easiest question "EQUAL TO 5,280 FEET" that the answer is "MILE". The player then combines the answers derived from all three levels 50, 52, and 54 to give the correct answer "ZERO MILESTONE". As shown in FIGS. 11–15, at the bottom of each card 30 is the answer 48 to the questions 34 along with a brief description or definition of the answer. The CHANCE card 32 of FIG. 16 also includes the answer 48 at the bottom of the back side 46.

Figure 2:
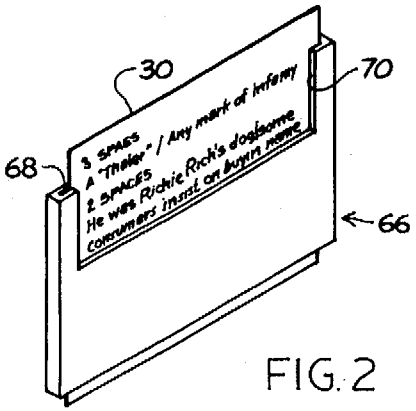
FIG. 2 is a perspective view of a scrolling pad for use with the board game first shown in FIG. 1.

As shown in FIGS. 3, 5, 6, and 8, the card sets 28 for each question category and also for the CHANCE category are held or stored within a plurality of question card boxes 56, and there is at least one card box 56 for each corresponding card set 28. Each card box 56 will have the title of the question category on its side 58 and front 60 and will also have a lid 62 which has indicia printed thereon designating the question category. Each card box 56 will also include a sleeve 64 attached to its front 60. The board game also includes a plurality of scrolling pads 66, as shown in FIGS. 2 and 4, and there will be one scrolling pad 66 associated with each respective question category. The scrolling pads 66 can be manufactured from cardboard backing material or plastic and will include a slot, such as the slot 68 shown in FIG. 2, extending therethrough so that all the cards 30 drawn from any of the card sets 28 can be passed through the slot 68. During play of the game, the players take turns holding one scrolling pad 66 while a particular card 30 is scrolled therethrough, or one player can be designated before the start of the game as the player who will manipulate the scrolling pad 66. As shown in FIGS. 2 and 4, each scrolling pad 66 has a cut-out section 70, or window, to allow the player holding the scrolling pad 66 to read questions 34 from the respective levels 50, 52, and 54 as the card 30 is scrolled upward.

Figure 5:
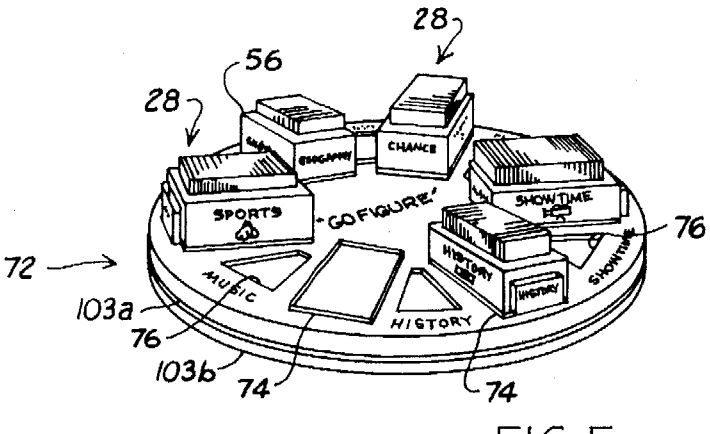
FIG. 5 is a first preferred embodiment of a turntable for use with the board game first shown in FIG. 1.

As shown in FIG. 5, during play of the game, the card boxes 56 are disposed within a rotatable question card box holder 72 having a plurality of compartments, or enclosures, sized to receive a respective card box 56. As shown in FIG. 5, the compartments, or enclosures, may be in the form of rectangular enclosures 74 having walls approximately one-quarter-inch high and into which the card boxes 56 are placed.

Figure 6:
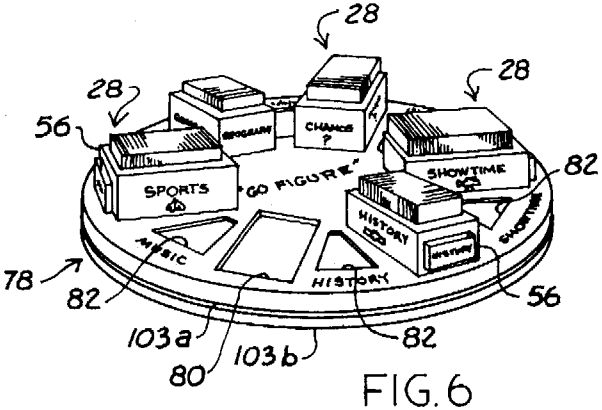
FIG. 6 is an alternate embodiment of the turntable first shown in FIG. 5.
Figure 3:
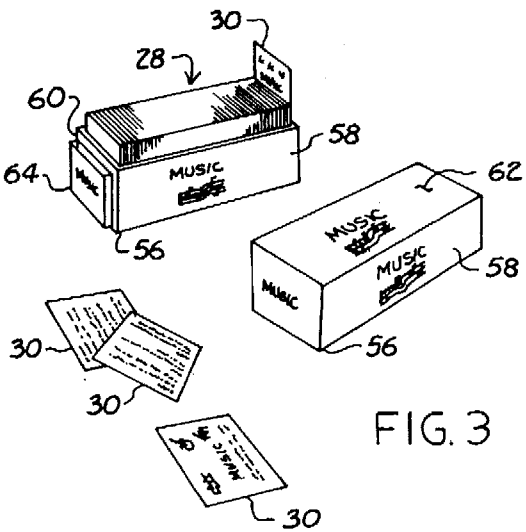
FIG. 3 is a perspective view of a plurality of card boxes and question card sets which are used with the board game first shown in FIG. 1.
Figure 7:
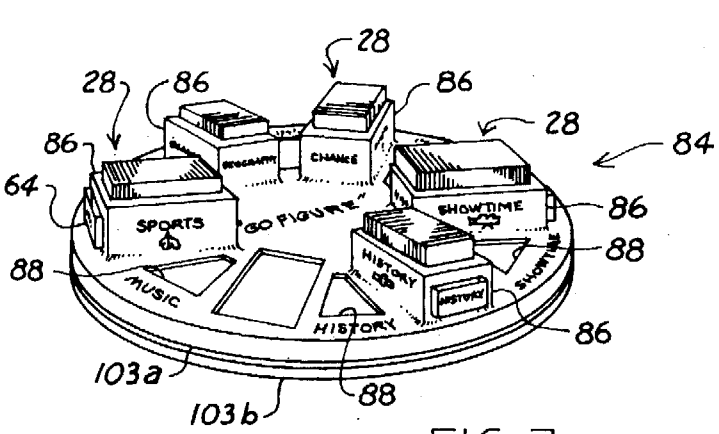
FIG. 7 is a second preferred alternate embodiment for the turntable first shown in FIG. 5.

Each enclosure 74 is separated by a depression 76 having the shape of a rhombus and capable of holding various items related to play of the game. FIG. 6 illustrates an alternate version to the holder 72 of FIG. 5. In FIG. 6 a question card box holder 78 is shown which includes slight, rectangular-shaped depressions 80 for receiving the card boxes 56 and smaller rhombus-shaped depressions 82 interposed between the depressions 80. The depressions 82 can hold any of various items and playing pieces related to the game. FIG. 7 illustrates a second alternate embodiment to the holder 72 of FIG. 5. In FIG. 7, a question card box holder 84 is shown in which question card boxes 86 are pre-molded onto the holder 84. Each box 86 contains one respective card set 28 that corresponds to the category name printed on the outside of each box 86. Each box 86 will include a lid (not shown). The holder 84 will also include pre-formed depressions 88 interposed between each box 86. The depressions 88 are rhombus-shaped and can receive and hold a variety of items related to the board game.

As shown in FIG. 4, a token means is used to represent the players as they move on the course 14 during play of the game. The token means are disposed on the course 14 for forward or backward movement thereon. The token means of the board game includes a plurality of playing pieces 90 in the form of upright molded figures resembling chess pawns; but other playing pieces or icons, such as any small toy or household item, can be used as long as they can fit within the playing spaces 16 and the END space 22. Using such items as a small toy or household figurine can add personalized touches to play of the game.

Figure 10:
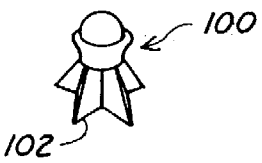
FIG. 10 is a perspective view of an alternate embodiment of the playing piece first shown in FIG. 9.
Figure 9:
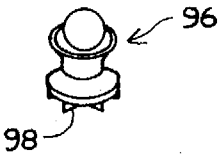
FIG. 9 is a perspective view of a playing piece capable of being carried on the turntable first shown in FIG. 8.
Figure 8:
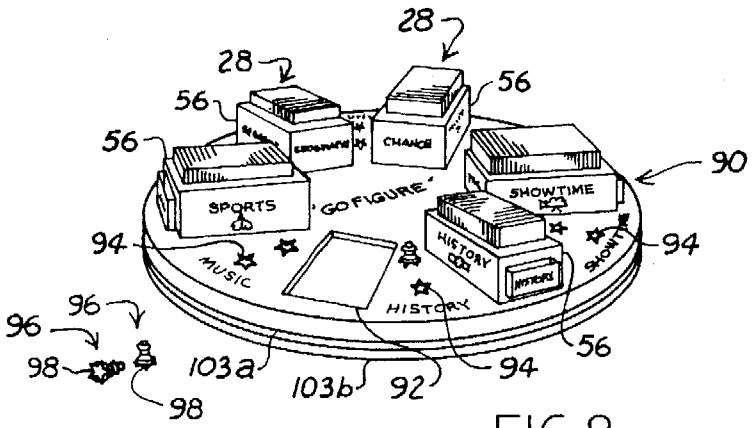
FIG. 8 is a third preferred alternate embodiment for the turntable first shown in FIG. 5.

FIG. 8 illustrates an alternate embodiment to the playing pieces 90 of FIG. 1 and also a third alternate embodiment to the holder 72 of FIG. 5. FIG. 8 illustrates a question card box holder 90 having a plurality of spaced-apart enclosures 92 radially spaced about the periphery of the holder 90. The enclosures 92 are similar to the enclosures 74 of FIG. 5. However, instead of the depressions 76 of FIG. 5, interposed between each radially-spaced enclosure 92 for receiving the boxes 56 are a plurality of spaced-apart, star-shaped indentations or depressions 94. In the holder 90 of FIG. 8, two depressions 94 are shown between each enclosure 92. FIGS. 8 and 9 also illustrate two playing pieces 96 which resemble chess pawns. The playings pieces 96 have bases 98 which are star-shaped and have a diameter equal to or less than the diameter of the bodies of the playing pieces 96. The bases 98 are sized to be removably insertable into the indentations 94 and, when the holder 90 rotates, the playing pieces 96 remain in the indentations 94 because of the snug fitting of the bases 98 therein. FIG. 10 illustrates an alternate embodiment to the playing pieces of FIGS. 8 and 9. In FIG. 10, a playing piece 100 has the top of a pawn but tapers to a star-shaped base 102. The base 102 will be sized to fit snugly with the indentations 94.

The holders 72, 78, 84, and 90 include an upper, freely-rotatable member **103*a* and a lower stationary member 103*b*. Using a conventional bearing means (not shown), the member 103*a* freely rotates, clockwise or counterclockwise, upon the member 103*b***.

Figure 17:
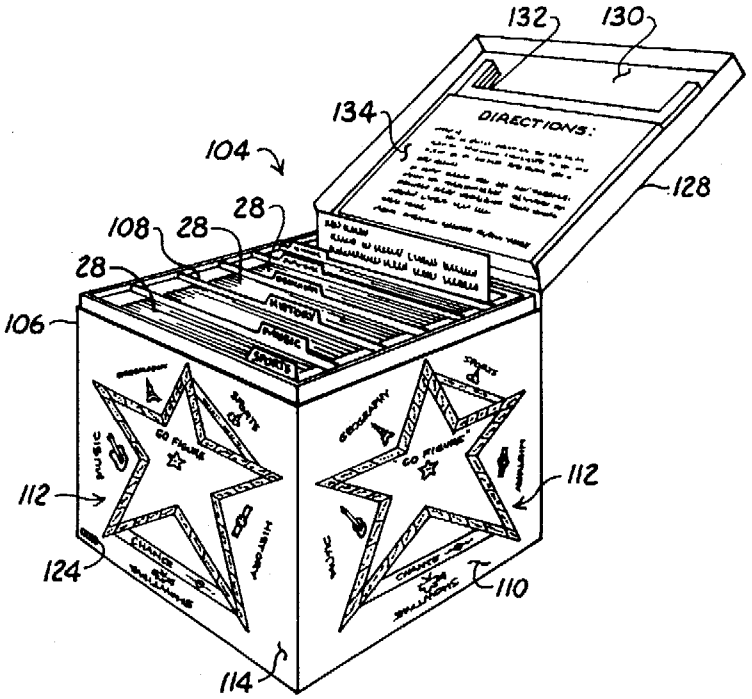
FIG. 17 is a perspective view of an alternate embodiment of the board game first shown in FIGS. 1–16.
Figure 18:
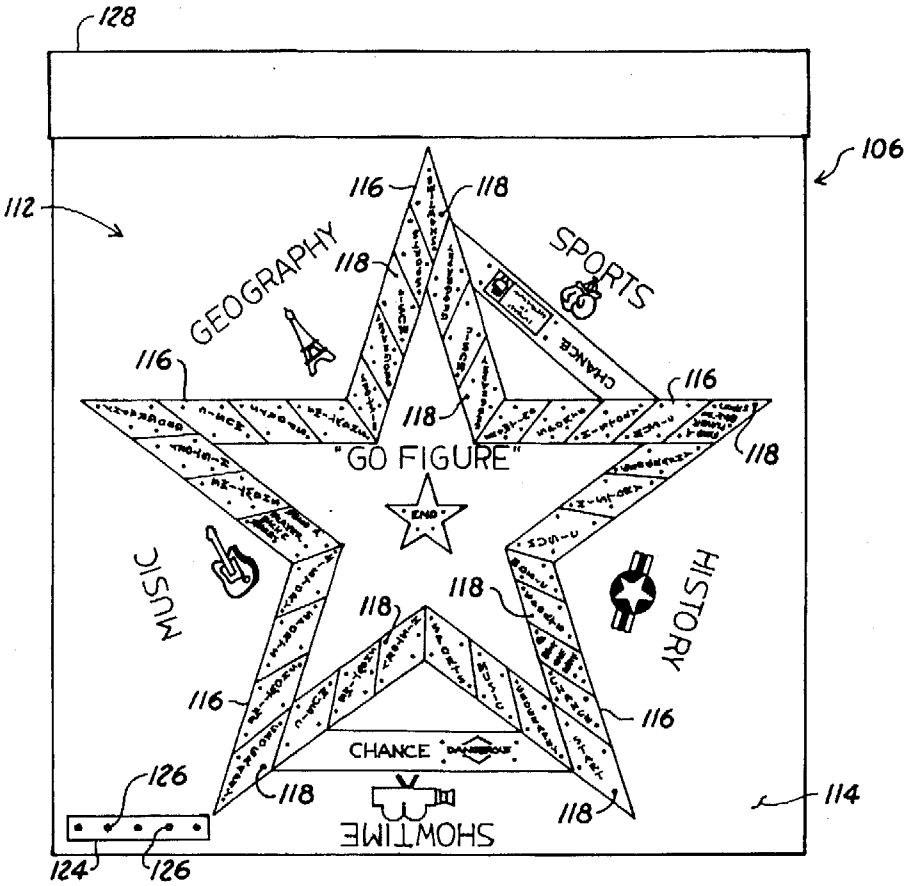
FIG. 18 is a front elevational view of the board game first shown in FIG. 17.

Illustrated in FIGS. 17 and 18 is an alternate embodiment to the board game of FIGS. 1–16 which may be referred to as the "travel game embodiment". The travel game embodiment 104 includes a box 106 wherein the card sets 28 for each question category are contained. Dividers 108 separate the respective card sets 28 from each other and on sidewalls 110 of the box are representations of a playing course 112 similar to that shown in FIGS. 1 and 4. A front wall 114 of the box 106 includes a course 112 which will be actually used by the players, and the course 112 is a miniature version of the course 14 originally shown in FIGS. 1 and 4. The major difference is that located within each playing space 116 are four peg holes 118. An end space 120 also includes a plurality of peg holes 122 and, in the alternate embodiment illustrated in FIG. 17, four holes 122 are used. Located in the lower left-hand corner of the front wall 114 is a peg holder 124, which is simply a rectangular compartment having a plurality of peg holes 126. In the holder 124 shown in FIG. 17, five holes 126 are shown. Disposed within each hole 126 is a distinctively colored plastic or wooden playing piece (not shown), and, in the alternate embodiment of FIGS. 17 and 18, the playing piece is simply a wooden or plastic peg.

As shown in FIG. 17, the box 106 includes a pivotally-attached or hinged lid 128 which is capable of fully opening so that the lid 128 can be placed contiguous to the rear wall (not shown) of the box 106. Located on the inside cover 130 of the lid 128 is a pocket 132, and the directions for playing the travel game embodiment 104 may be printed on the outside surface 134 of the pocket 132. The scrolling pads 66, such as those shown in FIGS. 2 and 4, extra pegs, and writing material for keeping track of the winner of each game can be stored within the pocket 132. The cards 30 for each respective card set 28 may be enlarged to either 3"×5" cards or 5"×7" cards to fit within the box 106, depending on the actual size of the box 106. The theme, content, artistic decoration, and rules for the travel game embodiment 104 will be congruent with the preferred embodiment of the board game illustrated in FIGS. 1–16.

The rules of the board game are straightforward and simple. The board game must be played with at least two players, or two teams of players with each team composed of two or more players. Each player or team of players should set their playing pieces 90, 96, or 100 upon the START space 20 so that the playing pieces 90, 96, or 100 move to the left of the START space 20 in order to advance around the course 14 to the END space 22. When the playing piece 90 of a player commences on the START space 20 or lands on a SEND A PLAYER BACK TWO SPACES space 16, then that player can choose the question category from which he or she wishes to answer the questions 34. In addition, the player that lands on the SEND A PLAYER BACK TWO SPACES space 16 can choose one of the question categories for which that player will attempt to answer questions 34 while at the same time selecting another player to be sent backward on the course 14. Each player or playing team advances to the left of the START space 20 and once the players traverse, in their turns, the course 14, they must enter the END space 22. As each player or playing team finishes their movement on the course 14, they can enter the END space 22 by simply picking up their playing piece 90 and setting it on the indicia denoting the END space 22 after correctly answering a question to get to the END space 22.

As each player enters the END space 22, they are given a CHANCE card 32 to answer; the objective of the game is to be the first player to reach the END space 22 and answer a CHANCE card 32 correctly. As previously described, each card set 28 has its own scrolling pad 66. Although the questions 34 on each card 30 and 32 are meant to be read to the players, some players may wish to personally see the particular question for reasons such as spelling or pronunciation. Therefore, each scrolling pad 66 enables players to see only one level 50, 52, or 54 at a time without revealing the answer.

To begin play of the game, each player or playing team places their playing pieces 90, 96, or 100 on the START space 20. After determining the sequence in which the players will proceed, the first player chooses a question category from which he or she would like to answer. If that player answers the questions 34 correctly from any level 50, 52, or 54, then that player advances the number of spaces 16 corresponding to the correctly answered question level 50, 52, or 54. The next player in the sequence then selects a question category for which he or she would like to answer. If any player fails to answer the questions 34 from all levels 50, 52, and 54 of the card corresponding to the question category of the space 16 on which they land, then that player must remain on the same space 16, and the next player in the sequence selects a question category. This sequence of play repeats itself until one player who has advanced to the END space 22 answers a CHANCE card 32 correctly. That player is the winner of the game. The playing pieces 90 can then be returned to the START space 20 and a new game can be commenced.

It should be noted that no timer is needed with the present board game, and play of the game should not take more than one hour. There is the possibility that individualized question categories denoted on the spaces 16 will be used before one or more players go from the last space 16, which is a CHANCE space, to the END space 22. However, there are enough spaces 16 on the course 14 that if a player played a perfect game (meaning that the player answered each question 34 at level 50 for three spaces for the question categories denoted on the spaces 16 on which he landed), then that player would answer fourteen questions in all. Even using the CHANCE pathways 24, a perfectly played game would consist of thirteen correctly answered questions. If the CHANCE pathways 24 were not used and the player advanced only on the course 14, then that player would traverse an additional five spaces 16.

As the board game is presently designed, each player must traverse the course 14 and enter the END space 22, and then answer a CHANCE card 32 question in an attempt to win the game. If two players started out the same, answering questions 34 at level 50 for the maximum three spaces each turn, and one player took both CHANCE pathways 24 and the other player did not, then the player who took both CHANCE pathways 24 would reach the END space 22 in the same amount of turns as the player who did not. The CHANCE pathways 24 are advantageous to the player only if the opponents do not answer all of their questions 34 for the maximum three spaces. The board game is also designed to use strategic logic when approaching the GO BACK ONE SPACE space 16 and the SEND A PLAYER BACK TWO SPACES space 16. It should be noted that if a player lands on the GO BACK ONE SPACE space 16, that player moves his playing piece 90 back one space and then attempts to answer the questions 34 on the card 30 corresponding to the question category denoted on that space 16. Players should evaluate how they wish to answer questions 34 upon reaching these spaces 16 along the course 14. This element of the board game should enhance competition based on the fact that if certain players fall behind during play of the game, they can then use these particular spaces 16 to catch up to those players ahead of them.

The board game is also designed so that all the players will reach the END space 22 irrespective of whether they answer questions 34 for one, two, or three spaces. This will eliminate any confusion regarding how to conclude the game. Special consideration was given to the last three spaces 16 since all questions 34 are based on answers worth one, two, or three spaces of movement on the course 14. Players will never be given the opportunity to answer a question 34 for three spaces when they are only one space away from the END space 22. This avoids the problem of having a player or players reach the end of the course 14, which is the CHANCE space 16, only to become stranded there because they are unable to correctly answer a question 34 from any level 50, 52, or 54 which will allow them to move into the END space 22.

The present board game is designed for fairly fast play insofar as all players should be able to recognize the answer to the questions 34 by the time they reach the easiest level 54 worth one space. Because of this design, the board game will encourage participation by all players. The game is designed so that one player goes, and regardless of whether or not that player answers his particular set of questions 34 correctly or incorrectly, the next player then follows in the play of the game. This allows players who are answering questions 34 from level 54 for one space to actively participate with those players who are answering questions 34 from levels 52 or 50 for, respectively, two or three spaces. Another attribute of the present board game is that it requires no detailed and extensive knowledge of the subject matter of the various question categories. This should be an additional encouragement to participation in that no player should feel less intelligent than any other player for not having superior knowledge of the subject matter of one or more of the question categories.

Therefore, the foregoing is considered as illustrative only of the principles of the present board game apparatus invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

I claim:

1. A board game for play by a plurality of players, the educational board game comprising:

a playing board having a playing surface and upon which a playing course is represented for defining a path of travel for the players;

the playing course including a plurality of joined playing spaces;

a majority of the playing spaces containing indicia which denote a particular question category representative of a plurality of question categories and at least one playing space containing indicia which designates that playing space as the space on which play of the game is to commence;

an end space located within the playing course and containing indicia which designates the end space as the space on which play of the game concludes;

a plurality of question card sets with each question card set representing one particular question category corresponding to one of the question categories denoted on at least one of the playing spaces;

a plurality of question cards for each question card set each of which contains a plurality of questions arranged in descending order of difficulty from most difficult level to least difficult level and all the question levels interrelated so that correct answers to questions from one level can be used as clues to answer questions for the next level, and each level of difficulty on each question card having said plurality of questions, wherein the correct answer to each of the question in a level of difficulty on one question card are interrelated such that when the correct answers are combined, the combined correct answers denote a person, place or thing; and token means for use by the players and which are disposed on the playing course for forward or backward movement thereon during play of the game.

2. The board game of claim 1 wherein at least one playing space of the playing course includes indicia directing that the player landing thereon can send any other player backward on the playing course a plurality of playing spaces.

3. The board game of claim 1 wherein at least one playing space of the playing course includes indicia directing that any player landing thereon must move backward one playing space.

4. The board game of claim 1 wherein at least one question card set contains questions which are drawn from all of the question categories.

5. The board game of claim 1 further comprising an end space located within the playing course and containing indicia which designates the end space as the space on which play of the game is to conclude.

6. A board game for play by a plurality of players, comprising:

a playing board having a playing surface upon which a playing course is represented in the shape of a five-pointed star for defining a path of travel for the players;

the playing course including a plurality of joined playing spaces;

a majority of the playing spaces containing indicia denoting a representative question category selected from a plurality of question categories and at least one playing space containing indicia for denoting that playing space as the space on which play of the game is to commence;

a plurality of question card sets with each question card set representing one particular question category corresponding to one of the question categories denoted on the majority of the playing spaces;

a plurality of question cards for each question card set each of which contains a plurality of questions arranged in a descending order of difficulty from most difficult to least difficult so that correct answers to questions from one level can be used as clues to answer questions from the next level;

token means for disposition on the playing course so that the token means can move forward or backward on the playing spaces during play of the game and the token means representing the players during play of the game;

a plurality of question card boxes with each question card box receiving and holding therein one respective question card set; and a rotatable question card box holder having a plurality of compartments so that each compartment can receive and hold therein one question card box.

7. A board game for play by a plurality of players, the board game comprising:

a playing board having a playing surface upon which a playing course is represented in the shape of a five-pointed star for defining a path of travel for the players;

the playing course including a plurality of joined playing spaces;

a majority of the playing spaces containing indicia denoting a representative question category selected from a plurality of question categories and at least one playing space containing indicia for denoting that playing space as the space on which play of the game is to commence;

a plurality of question card sets with each question card set representing one particular question category corresponding to one of the question categories denoted on the playing spaces;

a plurality of question cards for each question card set each of which contains a plurality of questions arranged in a descending order of difficulty from most difficult level to least difficult level so that correct answers to questions from one level can be used as clues to answer questions for the next level;

token means for use by the players disposed on the playing course for forward or backward movement thereon during play of the game;

a plurality of question card boxes with each question card box capable of receiving and holding therein one question card set; and a rotatable question card box holder having a plurality of compartments so that each compartment can receive and hold therein one question card box.

* * * * *